US006658772B2

(12) United States Patent
Haghighi

(10) Patent No.: US 6,658,772 B2
(45) Date of Patent: Dec. 9, 2003

(54) MULTI SURFACE BILLBOARD

(76) Inventor: Manouchehr Haghighi, 1324 Berkeley St. #1, Santa Monica, CA (US) 90404

( * ) Notice: Subject to any disclaimer, the term of this patent is extended or adjusted under 35 U.S.C. 154(b) by 0 days.

(21) Appl. No.: 09/922,809

(22) Filed: Aug. 7, 2001

(65) Prior Publication Data

US 2003/0029065 A1 Feb. 13, 2003

(51) Int. Cl.[7] ..... G09F 11/30
(52) U.S. Cl. ..... 40/511; 40/492
(58) Field of Search ..... 40/503, 504, 505, 40/508, 509, 511, 492

(56) References Cited

U.S. PATENT DOCUMENTS 950,166 A * 2/1910 Douglas ..... 40/505
2,546,236 A * 3/1951 Plueger ..... 40/505
3,229,395 A * 1/1966 Belisle ..... 40/505
3,514,883 A * 6/1970 Albright ..... 40/492
5,303,760 A * 4/1994 Perez ..... 40/505
5,806,221 A * 9/1998 Vander Woude ..... 40/503
6,052,931 A * 4/2000 Werner ..... 40/505

* cited by examiner

*Primary Examiner*—Gary Hoge
(74) *Attorney, Agent, or Firm*—John P Halvonik

(57) ABSTRACT

A bill board apparatus for displaying multiple messages from a plurality of message segments. A series of message segments are arranged upon an axis so as to form a complete display message by a minimum of two segments. A swing arm or actuator arm that is in conection with the first sign segment of the plurality of segments turns each segment 180° in order to display a different message when the time has come to display a new message. A computer may be used to actuate the actuator and this may be programmed so as to display different messages for different lengths of time.

2 Claims, 6 Drawing Sheets

36
36
2
8
6
3
20
1

18
36

20
22
24

16
17

MULTI SURFACE BILLBOARD

FIELD AND BACKGROUND OF THE INVENTION

The invention relates to the field of signage and in particular to a multi surface billboard able to provide a series of messages or signs that can be changed by a computer control or other type of control. The billboard comprises a series of several sign panels capable of presenting one or more advertisements or other types of signs upon the same billboard. The invention allows each of the advertisements to be displayed several times per day.

It is thought that the invention will have a great use in the signage industry since many messages can be displayed upon one message board whereas most prior art signage systems can only display one message per one billboard.

PRIOR ART

Several prior art patents also relate to displaying more than one sign through a given period of time. U.S. Pat. No. 5,511,330 is entiled; "Louver SIgn Transmission System;" U.S. Pat. No. 5,161,421 is a driving device for driving or operating elongate display members at signs for consecutive repeated presentations of series of images; and U.S. Pat. No. 5,259,135 entitled "Display Device."

The mechanics used in these various prior art devices are quite different from the invention described here. These inventions also differ in their approach to creating a billboard that can generate a multiple series of messages.

SUMMARY OF THE INVENTION

A bill board apparatus having a plurality of surfaces or sign segments arranged upon a shaft, so that that the surfaces may be moved one by one by an actuator arm so as to display multiple messages from one billboard. A computer may be used to control the time that each message is displayed and then actuate the arm in order to display the next message. A module comprises at least two sign segments but there may be more and a module displays a complete display message. Each sign segment is connected to the shaft by means of an upper and a lower connecting arm.

There is a swing arm or actuator arm that is in conection with the first sign segment of the plurality of segments. The actuator then turns each segment 180° in order to display a different message when the time has come to display a new message. Thus when there are two segments in a module, say a left and right segment, the actuator arm will turn say the left segment 180° in order to reveal the reverse side of this segment having a different message then the front side. This movement will also reveal a new sign segment that will form the right hand segment of the message, so that together the left and right segments will form a new advertising message. There is a flexible means in connection with the signs in order to keep them in alignment.

It is is an object of the invention to provide a billboard having the ability to generate many different signs or messages on one billboard.

Another object is to provide a billboard with multiple display messages that can assign a time period for the display of each message so that different display times can be allocated to certain of the messages in the plurality of messages.

Another object is to provide a billboard with multiple display messages that has a sign surface that need only be comprised of two movable sign panels.

Another object is to provide a billboard with multiple display messages that can generate a large revenue stream for the owner and operator because different advertising times may be assigned to various messages in the billboard.

Another object is to provide a billboard with multiple display messages that can provide multiple messages in an environment where space for such displays is limited.

Another object is to provide a billboard with multiple display messages that can replace the older types of billboard displays that lack the ability to display more than one message.

Another object is to provide a billboard with multiple display messages that can be quickly erected by the operator and can be easily set up without danger to passersby and motorists.

Another object is to provide a billboard with multiple display messages that can be controlled by a computer that can be preprogrammed for the display time for each message and where the computer can be programmed from a remote location and then brought to the display.

Another object is to provide a billboard with multiple display messages that can be operated by a computer from a remote location.

Other objects of the invention will be known once the invention is shown and described.

DETAILED DESCRIPTION OF THE INVENTION

Figures 1, 1A, 1B, 1C, 1D:
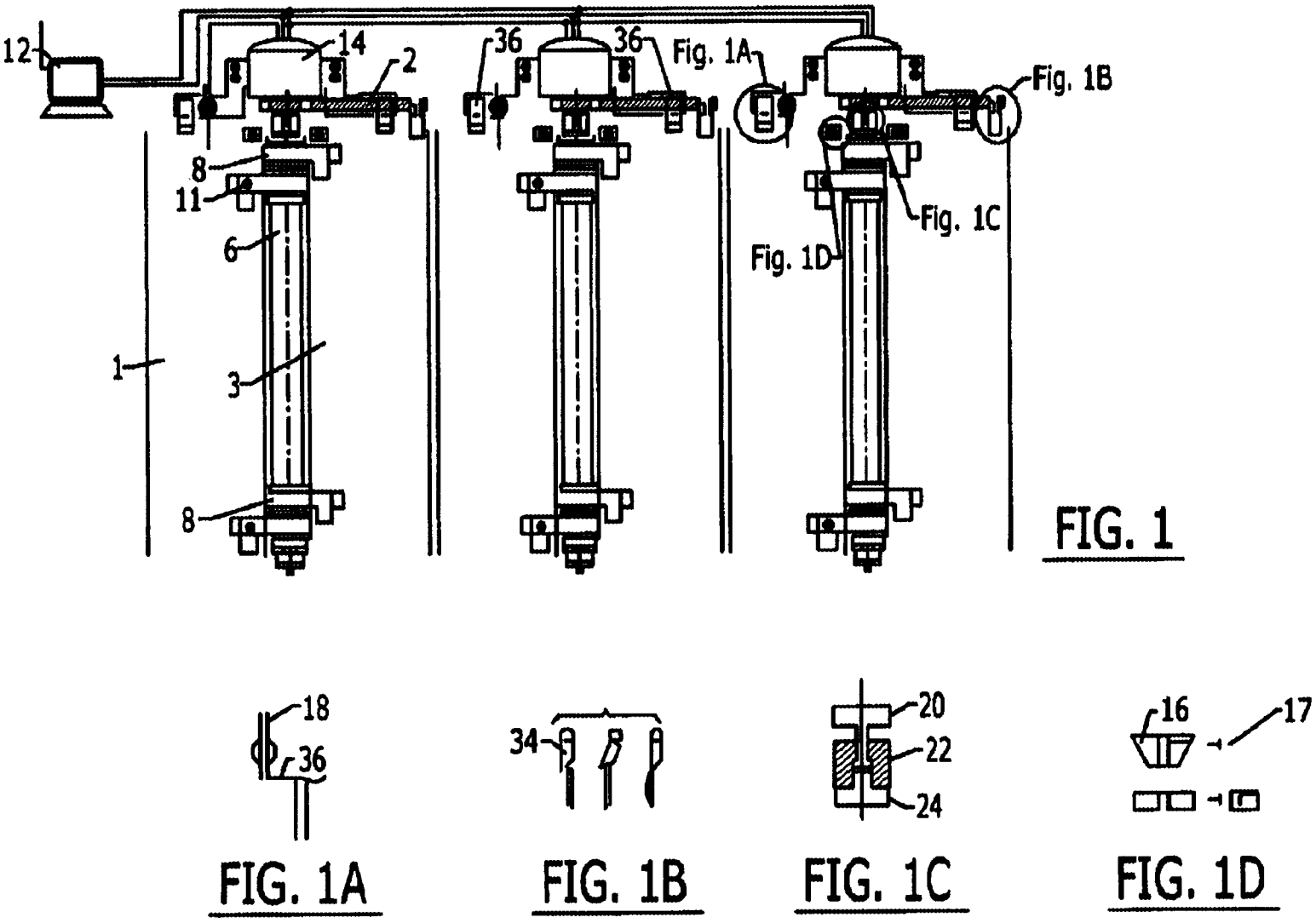
FIG. 1. overall view of sign display apparatus with inset figures to illustrate details.
Figure 2:
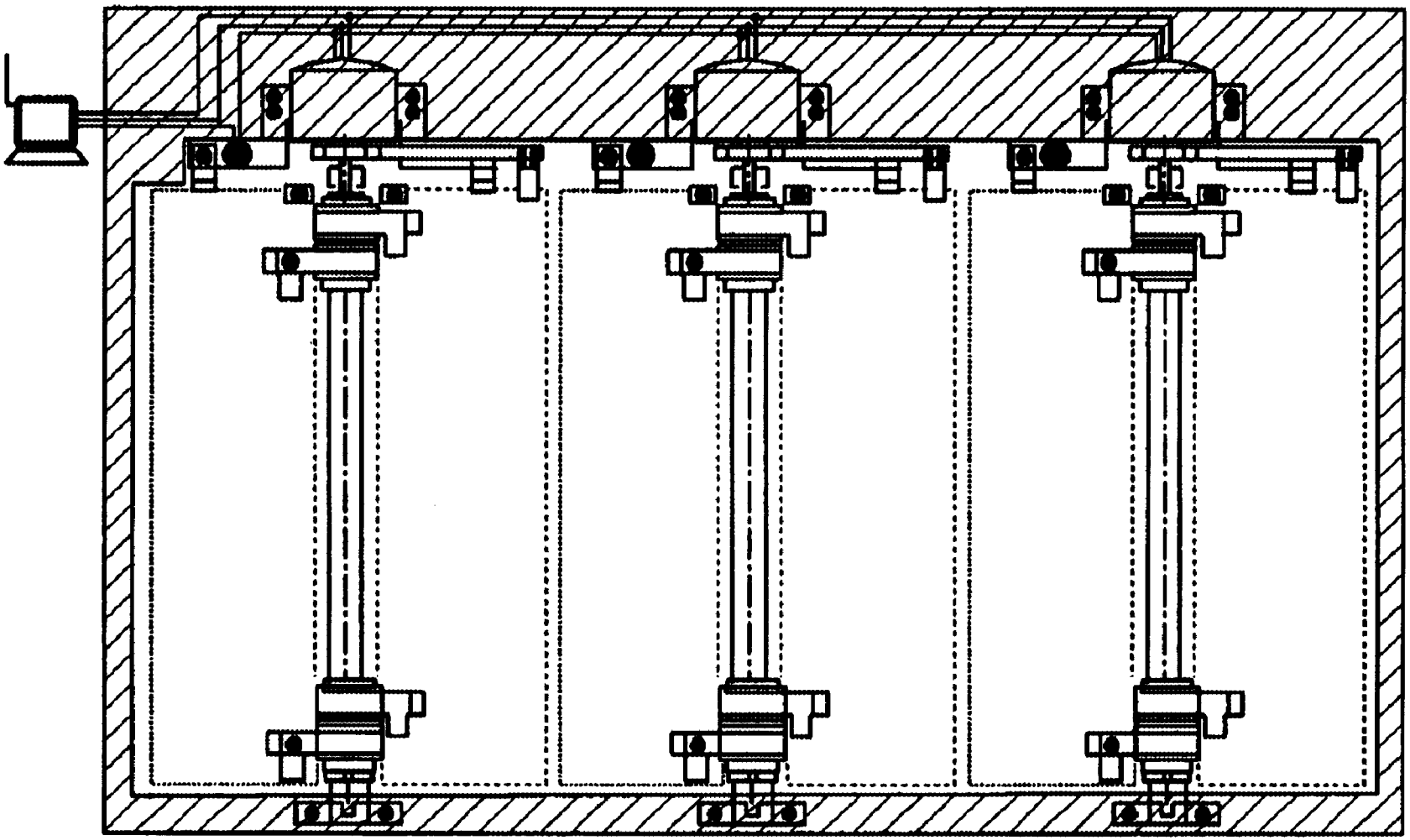
FIG. 2 overall view of sign display.
Figures 3, 3A, 3B, 3C, 3D, 3E:
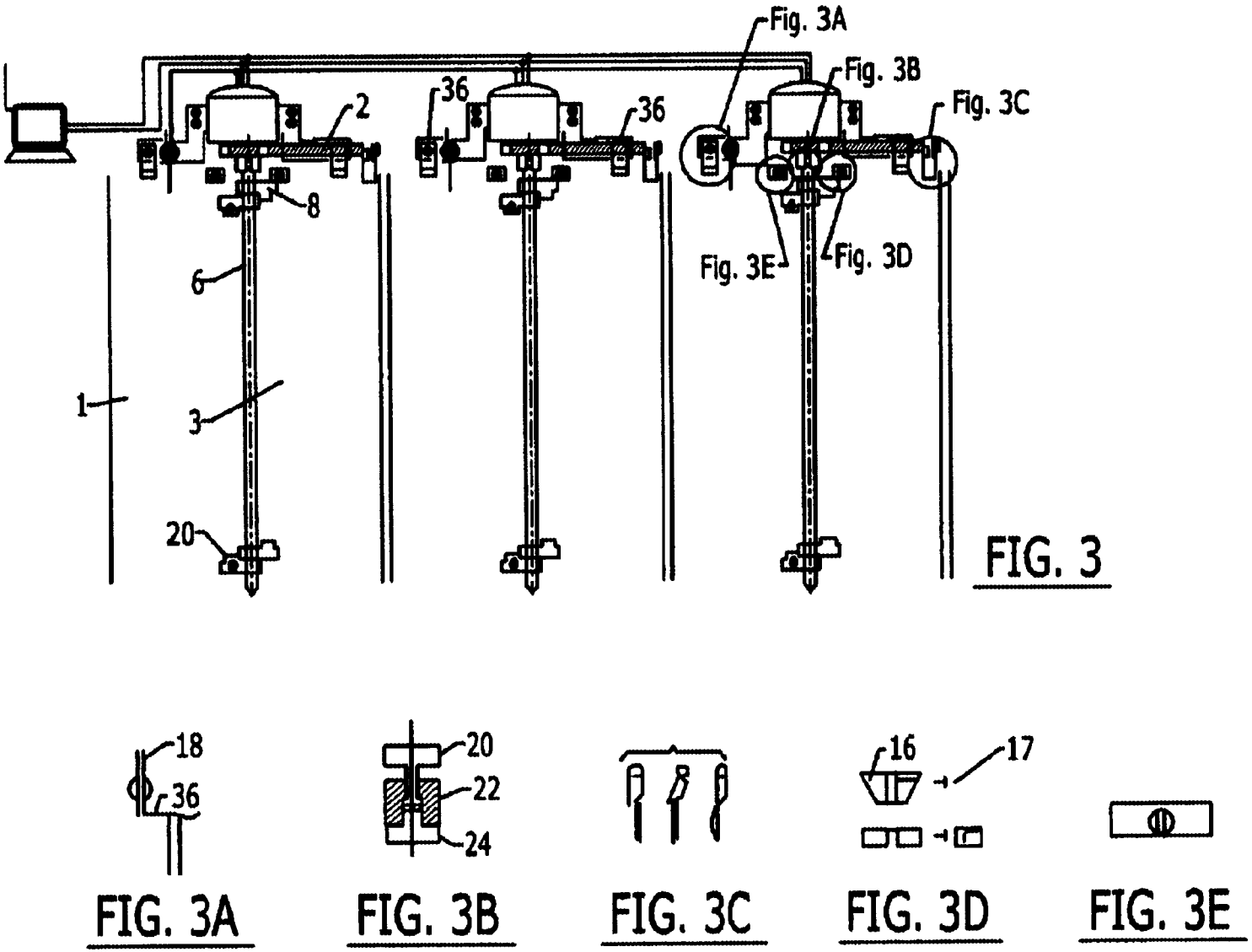
FIG. 3 another overall view showing that a smaller vertical shaft can reduce the gap size.

The overall construction of the sign display apparatus is as shown in FIGS. 1–3. There are three display modules shown in FIG. 1 and each module really represents that one small display segment of the overall sign that is to be displayed at any one time. Each module will carry with it a number of different display segments (shown as sign panels ⅓ in FIG. 1) for different advertising messages so that a number of different advertising messages can be displayed by multiple actions of this apparatus.

Figure 9:
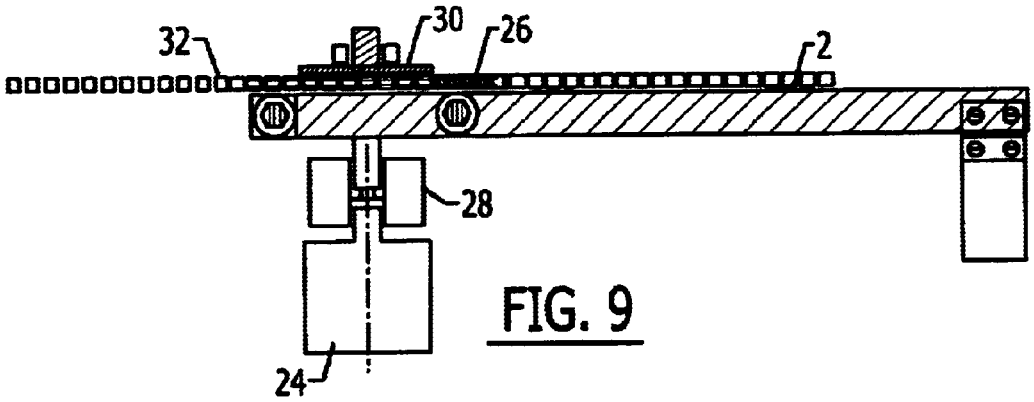
FIG. 9 detail of quick release coupling.

Each module uses a motor has a swing arm attached to the shaft of the motor as seen in FIGS. 1 and 9. The swing arm essentially moves the display segment that is at the front of the pile 180° so that it will now be displayed. The rear surface of each segment has display indicia as well as the front surface so that each time a sign segment is rotated 180° this will cause a new portion of an advertising sign to be displayed.

For example in the case of two segments, there will be a left and right segment (k and h in FIG. 1). The actuator arm or swing arm will turn one of the segments, say the left hand one (it doesn't matter which one) and this segment will turn 180° to reveal the reverse side having one-half of the new display message. At the same time the next segment in the plurality of segments will be revealed and it will comprise the right hand half of the new message. Again, when the process is repeated, the right hand segment will be rotated 180° to reveal a new message, comprising a message on the back side of the right hand segment (now in the left hand position) as well as the new right hand segment which forms the other half of the message.

The sign panels are shown as K and h in FIG. 1. Each sign panel is connected to a vertical shaft 6 by means of a pair of connecting arms 8. Preferably there would be one connecting arm near the bottom of the sign segment and one near the top of the sign segment. Each of the sign segments in the display module will need to be connected to at least one connecting arm.

Each display segment may be connected to the connection arms by means of an Allen screw 10 or some other type of means for establishing a secure connection. Each of the shafts that hold the sign segments is not in connection with the drive means. That is to say that the shaft 11 will not rotate when the sign segments are turned by the swing arm. The sign segments are moved by the swing arm 2.

The swing arms may be driven by a computer means 12 that will send control signals to a motor 14 that will rotate all the swing arms in the display at the same time and each of the arms will rotate 180° at that time. When this occurs, all of the display segments in the sign display will change and the overall impression formed by display will be that of one advertising sign changing into another sign. The advertising indicia may be pasted or otherwise attached to the surface of each of panel.

Figures 4, 4A, 4B, 4C, 4D, 4E:
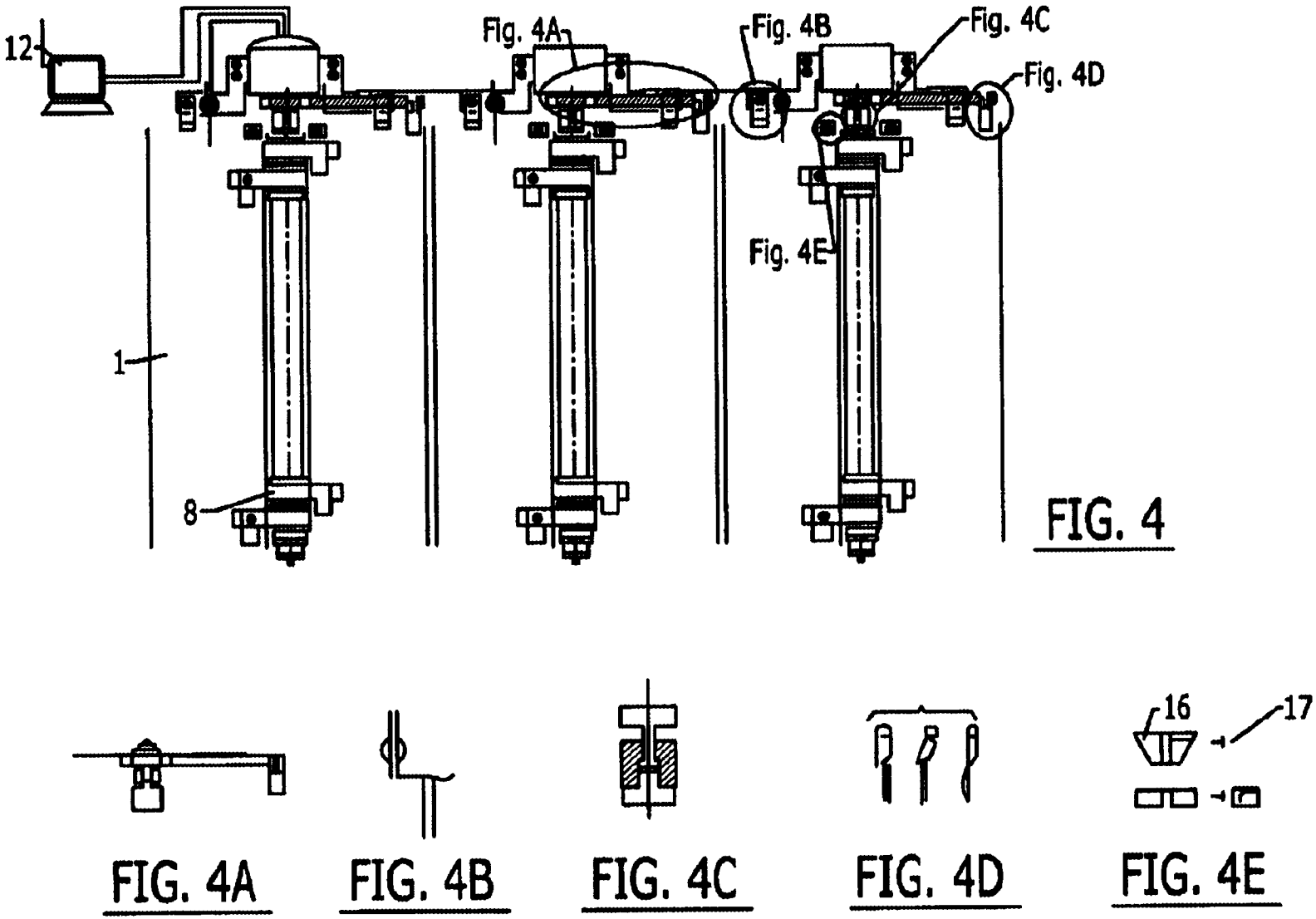
FIG. 4 another view with inset FIG. P to show quick release coupling.
Figure 5:
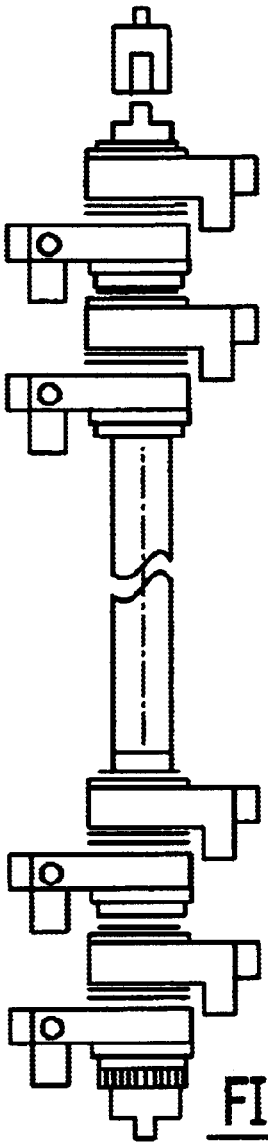
FIG. 5 detail of shaft.
Figure 6:
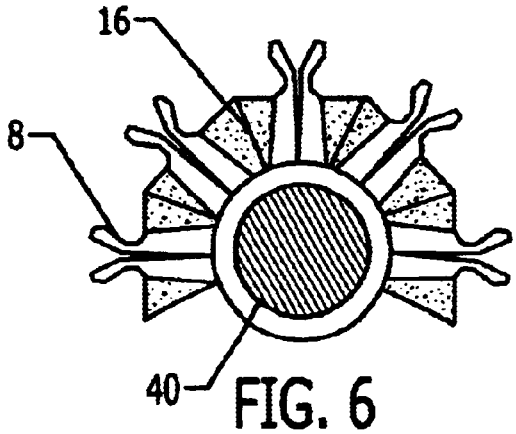
FIG. 6 top view looking down on the plurality of sign panels connected to one shaft.
Figure 7:
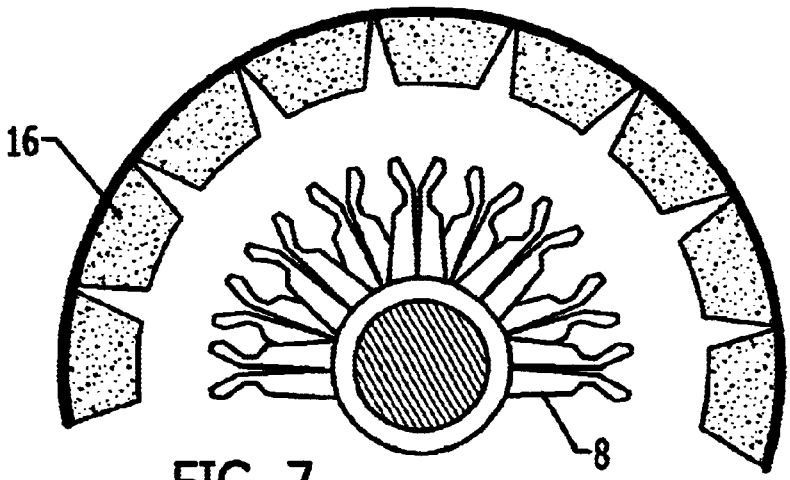
FIG. 7 another top view of sign panels with different spacing.
Figure 8:
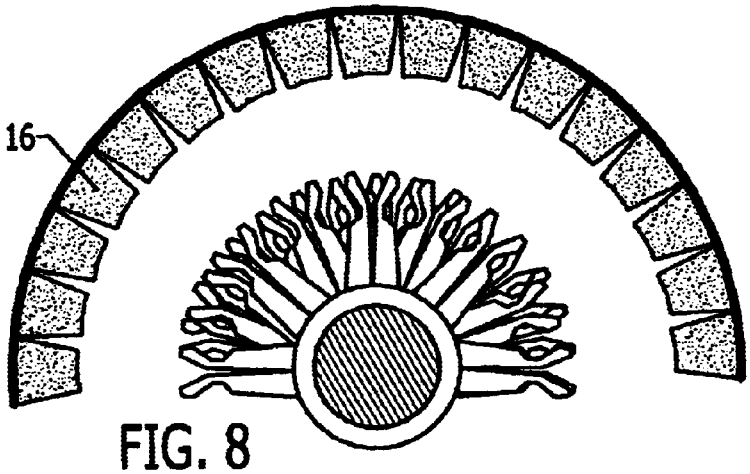
FIG. 8 another top view of sign panels with different spacing.

It is also possible to control the computer from a distance using a remote control to manage the display time. Although FIG. 1 only shows six sign panels there can be many more modules in the overall display apparatus. FIG. 3 shows two cams or connecting arms stacked upon one another and FIG. 4 shows cams placed on vertical shafts. Many more cams or connecting arms may be used as needed for the device to function optimally.

Each of the shafts should be manufactured with as small a diameter as possible so as to minimize the gap created in the sign where the shaft comes in, see FIG. 3. The shaft of course, runs vertically and this will create a gap in between the two display panels that comprise each module.

Spacers 16 are installed on the top edge of each display panel so as to separate each of the panels from one another. By moving the spacers outward away from the axis of the vertical shaft greater space between panels can be created. Details of the spacers are shown in inset FIG. H in FIG. 3 The angle selected for these spacers as shown is 45° but other angles can be used as well. Spacer have a slot in them to allow for travel upon the top edge of each sign panel so as to vary the distance between each of the sign panels in the display.

By increasing this distance, the space between panels is decreased and so more panels can be added to each module. In this manner more advertising signs can be displayed in the apparatus at any one time so that the number of available advertising displays in a given display can be varied.

A screw 17 may be used to secure each spacer firmly on the sign panel. FIGS. 1–3 shows a billboard of three sets of modules. The larger the sign panel is the larger is the radius of the swing. Smaller width sign panels are preferred because this will allow the billboard to have a smaller overall thickness. This will create more stable surface during high winds and such.

A stop bracket 18 maybe provided in order to hold a digital motor to the billboard. This bracket may also be designed in such a way to limit the swing of the swing arm to no more than 180°. The shaft 20 on the digital motor holds the swing arm and the quick release couplings 22. This coupling slides over the top portion of the vertical shaft 24 to hold the module in place. The lower part of the vertical shaft is inserted into a housing which is mounted to the billboard.

Inset FIG. N show details of a quick release coupling. This method of changing the modules is important for quick installation and to avoid excessive time spent on elevated billboards. It is preferred that the modules be prepared at a shop and advertising indicia be pasted to the panel before each installation to a billboard. FIG. 4 shows a billboard operated with one digital motor. In this case, the sprocket 26 mounted on the digital motor 14 is connected to the other sprockets, which with a chain 32 can effectively operate the system. The swing arm 2 is connected to each sprocket to perform the function of the rotation as before, see inset fig. P in FIG. 4 as well as FIG. 9.

There may be a holding ring like that shown in insert fig. Q in FIG. 3 in order to secure the connecting arms to the shaft. The holding ring may be any type of means that can prevent the arm from sliding up or down the shaft. The vertical shaft itself may be held in place by the quick release coupling 28 (insert fig. N).

The swing arm may be moved by a motor on a periodic basis. The time period may be determined by the operator of the sign display. The swing arm will rotate 180° both back and forth during the same actuation. There is one swing arm in connection with each display module. See insert fig. G.

At the end of each swing arm is a hinged carrier 34 and insert G. The hinged carrier is a biased piece that is urged into a position that is parallel to the plane of the sign segment. The arm which is equipped with a hinged carrier, on the first part of its 180° travel will move the hinged carrier with the sign segment forward until it snaps into the positioning spring and comes in contact with the limiteing switch.

The hinged carrier then reverses and swings 180° in the opposite direction because of the bissing means and it will then be positioned behind the sign segment. By doing this, it has returned back to its starting position. The forward motion of the arm will of course pile a segment of a sign 180° across the module and so display the display segment that is next in the line of display segments in the module.

Each stop bracket has two positioning springs 36, see inset F. The first forward motion of the swing arm forces the sign segment to snap into the left positioning spring. The force created also pushes all of the display segments forward until the right sign segment comes in contact with the right positioning spring.

The periodic actuation of the swing arm may be generated by a motor that is in connection with a timing means. The timing means may comprise a computer or some other device for actuating the arm on a periodic basis. The motors may be of any state of the art means that is found to be compatible with the apparatus.

The size of each sign segment may be varied in accordance with the needs of the operator.

I claim:

1. A bill board display apparatus comprising a plurality of shafts, each of said shafts having at least one connecting arm, each of said shafts in connection with a plurality of billboard segments so as to comprise a sign module, a series of said sign modules arranged in connection with one another so as to form a display plane where said billboard segments are coplanar with one another, said display plane for the display of a plurality of said billboard segments, each of said connecting arms in connection with one of said billboard segments, said plurality of said bill board segments comprising a single advertising display, a swing arm in connection with a means for rotating said swing arm 180° back and forth at periodic intervals of time, said swing arm having a free end, a flexible means in connection with said free end of said swing arm; said swing arm positioned upon said apparatus so that said flexible means will contact one of said billboard segments when said swing arm is rotated 180°; each of said connecting arms in connection with a spacer means for keeping said connecting arms at a distance away from one another, said spacer means fixed for axial movement along said connecting arms.

2. The apparatus of claim 1, wherein said means for rotating said swing arms comprises a drive sprocket in connection with at least one drive chain, each of said swing arms having a swing sprocket in connection thereof, each of said swing sprockets adapted for connection to said drive chain; said means for periodic rotation having a means to move said drive chain so as to move each of said swing arms simultaneous with one another.

* * * * *